US006162099A

United States Patent [19]

Wu

[11] Patent Number: 6,162,099

[45] Date of Patent: Dec. 19, 2000

[54] ELECTRICAL INTERCONNECTION MECHANISM

[75] Inventor: Ming-Chuan Wu, Su-Lin, Taiwan

[73] Assignee: Hon Hai Precision Ind. Co., Ltd., Taipei Hsien, Taiwan

[21] Appl. No.: 09/397,151

[22] Filed: Sep. 15, 1999

[30] Foreign Application Priority Data

Dec. 28, 1998 [TW] Taiwan ..... 87221624

[51] Int. Cl.[7] ..... H01R 12/00

[52] U.S. Cl. ..... 439/638; 439/67; 439/79

[58] Field of Search ..... 439/638, 67, 77, 439/74, 493, 79

[56] References Cited

U.S. PATENT DOCUMENTS 5,599,595 2/1997 McGinley et al. ..... 439/638

5,688,130 11/1997 Huang ..... 439/541.5

5,779,489 7/1998 Davis et al. ..... 439/79

5,895,278 4/1999 Humphrey ..... 439/67

5,947,764 9/1999 Pan et al. ..... 439/67

*Primary Examiner*—Gary F. Paumen

*Attorney, Agent, or Firm*—Wei Te Chung

[57] ABSTRACT

An electrical interconnecting mechanism comprises a FPC subassembly connecting with an inner circuit of a peripheral instrument, a connector mounted on a mother board, and a medium connector connecting the FPC subassembly with the connector thereby interconnecting the peripheral instrument with the mother board. A pair of bolts and a pair of nuts are provided to fix the medium connector to the peripheral instrument.

1 Claim, 3 Drawing Sheets

ELECTRICAL INTERCONNECTION MECHANISM

BACKGROUND OF THE INVENTION

The present invention relates to an electrical interconnection mechanism, and particularly to an electrical interconnecting mechanism which can be directly engaged with and disengaged from a peripheral instrument and can easily interconnect an electronic instrument with a mother board at low cost.

DESCRIPTION OF THE PRIOR ART

Flexible printed circuit (FPC) technology has been broadly adopted in computers to fulfill requirements of minimization. An FPC is traditionally used to interconnect a peripheral instrument with a mother board by being soldered to a corresponding contact portion of the mother board. An electrical connection between the FPC and the peripheral instrument usually can not be repeatedly disengaged, therefore, complicating repair and exchange of the peripheral instrument are complicated. This kind of direct electrical connection between the peripheral instrument and the mother board using FPC is outdated since it does not allow easy repair/ replacement of peripheral instrument, and can not keep up with increasingly advanced requirements of peripheral instruments of a computer. Moreover, the soldering connection between the FPC and the mother board is apt to suffer damage thereby adversely affecting communication therethrough.

Therefore, prior art adopted medium connector is thus adopted to interconnect a mother board of a computer with an FPC connected to a peripheral instrument, or with another connector connecting with the FPC. The medium connector is usually perpendicularly bent relative to the mother board and is exposed to an interface panel of the computer for connecting with a peripheral instrument. However, since the medium connector is manufactured to be perpendicularly bent relative to the mother board, electrical connection between the medium connector and the mother board is sensitive to mechanical damage after repeated engagements and disengagements.

Therefore, an improved electrical interconnecting mechanism is required to facilitate exchange and repair of a peripheral instrument after interconnecting the peripheral instrument with a mother board.

BRIEF SUMMARY OF THE INVENTION

A main object of the present invention is to provide an electrical interconnection mechanism which can easily interconnect a peripheral instrument with a mother board.

Another object of the present invention is to provide an electrical interconnecting mechanism which interconnect a peripheral instrument with a mother board by means of insertion thereby facilitating exchange and repair of the peripheral instrument.

An electrical interconnecting mechanism in accordance with the present invention comprises a flexible printed circuit (FPC) subassembly for connecting with a peripheral instrument, a connector mounted on a mother board and a medium connector for connecting the FPC subassembly with the connector.

The medium connector is fixed to the peripheral instrument by means of nuts and bolts thereby facilitating disengagement from the peripheral instrument. The medium connector comprises a first mating opening for engaging with the FPC subassembly and a second mating opening for engaging with the connector. The FPC subassembly is electrically connected with an inner circuit of the peripheral instrument and comprises a positioning member for engaging within the first mating opening of the medium connector. Since the medium connector is fixed to the peripheral instrument by nuts and bolts, the medium connector can be conveniently disengaged from the peripheral instrument and the FPC subassembly when the peripheral instrument is to be exchanged, repaired or moved.

Other objects, advantages and novel features of the invention will become more apparent from the following detailed description when taken in conjunction with the accompanying drawings.

DETAILED DESCRIPTION OF THE INVENTION

Figure 1:
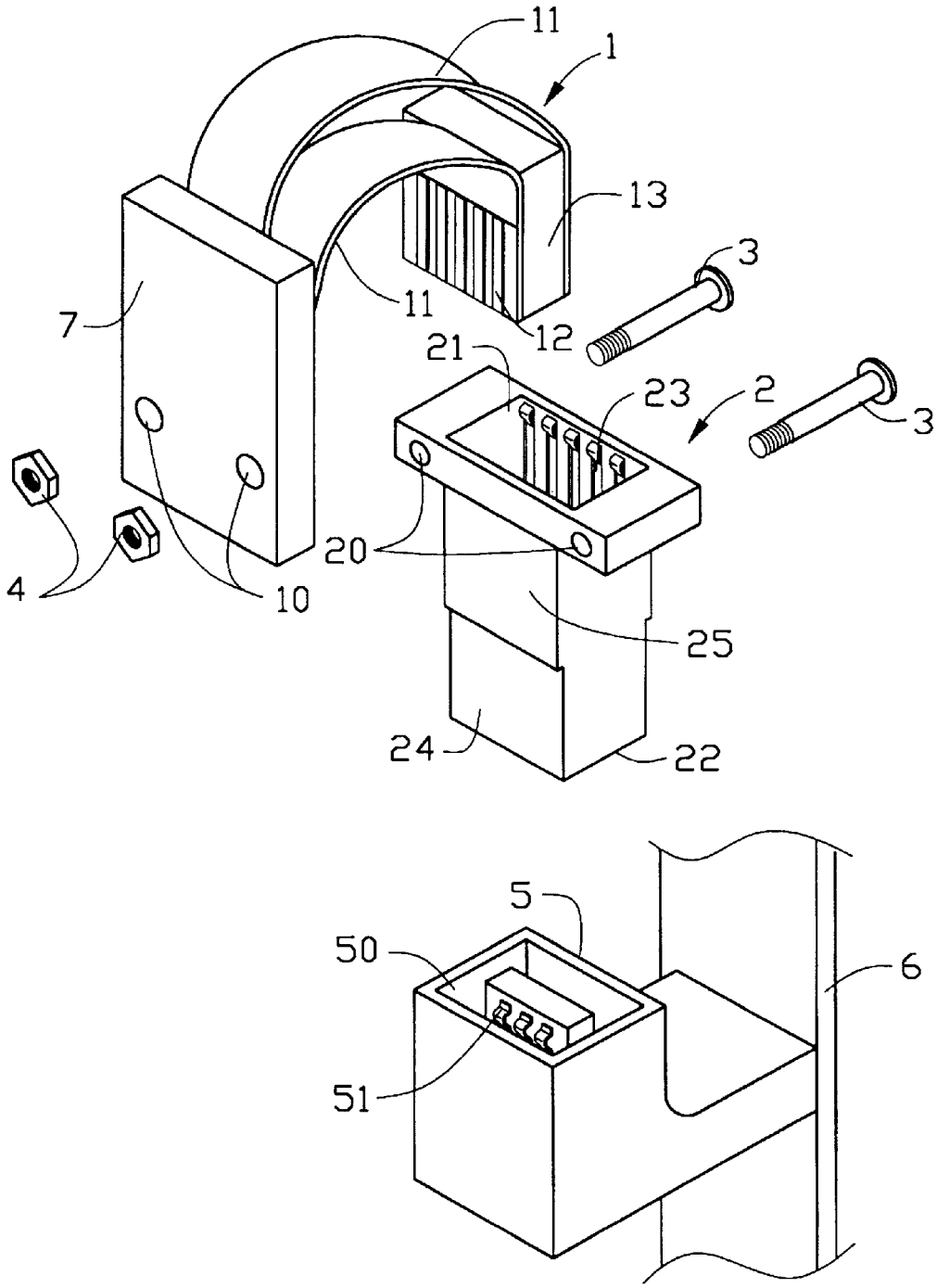
FIG. 1 is an exploded view of an electrical interconnecting mechanism of the present invention.
Figure 2:
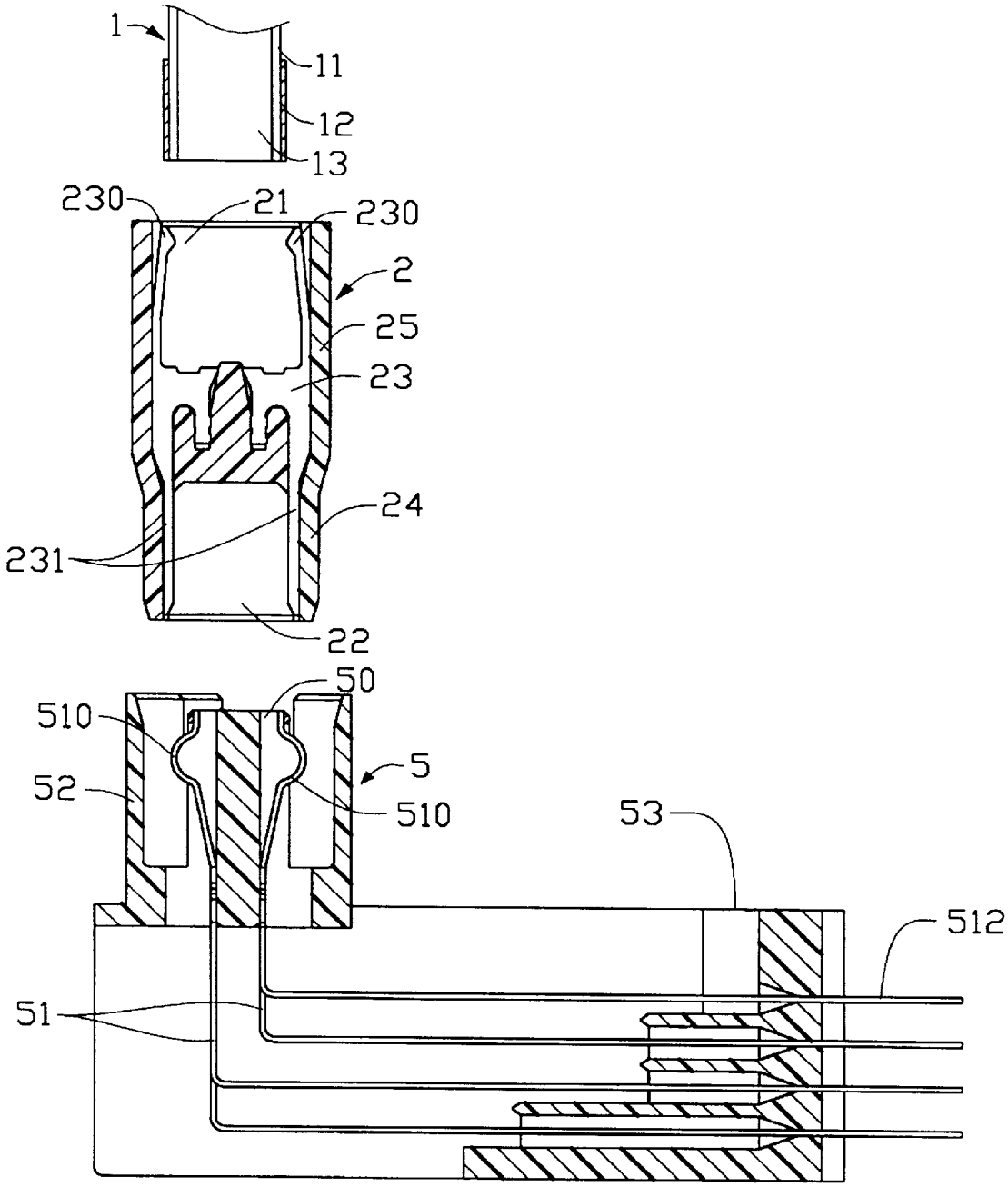
FIG. 2 is a cross-sectional view of FIG. 1.

Referring to FIGS. 1 and 2, an electrical interconnecting mechanism in accordance with the present invention comprises a flexible printed circuit (FPC) subassembly 1 connecting with an inner circuit of a peripheral instrument 7, a connector 5 mounted on a mother board 6, and a medium connector 2 interconnecting the FPC subassembly 1 with the connector 5.

A pair of screw holes 10 is defined in a plate body of the peripheral instrument 7. A pair of nuts 4 and a pair of bolts 3 are provided to fix the medium connector 2 onto the peripheral instrument 7 through the screw holes 10 of the peripheral instrument 7 and a pair of apertures 20 defined in the medium connector 2.

The FPC subassembly 1 comprises a FPC member 11 and a positioning member 13. The FPC member 11 is attached to opposite faces of the positioning member 13. A plurality of metal contacting fingers 12 is attached to opposite outer surfaces of the FPC member 11 proximate opposite bottom edges of the positioning member 13 for engaging with the medium connector 2.

The medium connector 2 comprises a first mating portion 25 for engaging the FPC subassembly 1, and a second mating portion 24 for engaging with the connector 5. A first mating opening 21 is defined in the first mating portion 25 for receiving the FPC subassembly 1. A second mating opening 22 is defined in the second mating portion 24. A plurality of contacts 23 is fixed within the medium connector 2. Each contact 23 comprises a first mating end 230 extending into the first mating opening 21 for engaging with the corresponding metal contacting fingers 12 of the FPC subassembly 1, and a second mating end 231 extending into the second mating opening 22 for engaging with the connector 5.

The connector 5 comprises a first engaging portion 52 and a second engaging portion 53 perpendicular to the first engaging portion 52. The first engaging portion 52 defines an engaging opening 50 for receiving the second mating portion 24 of the medium connector 2. A plurality of terminals 51 is fixed within the connector 5. Each terminal 51 is L-shaped and comprises a curved contact section 510 for contacting the second mating end 231 of the corresponding contact 23 in the medium connector 2, and a connecting end 512 for electrically connecting with the mother board 6.

Figure 3:
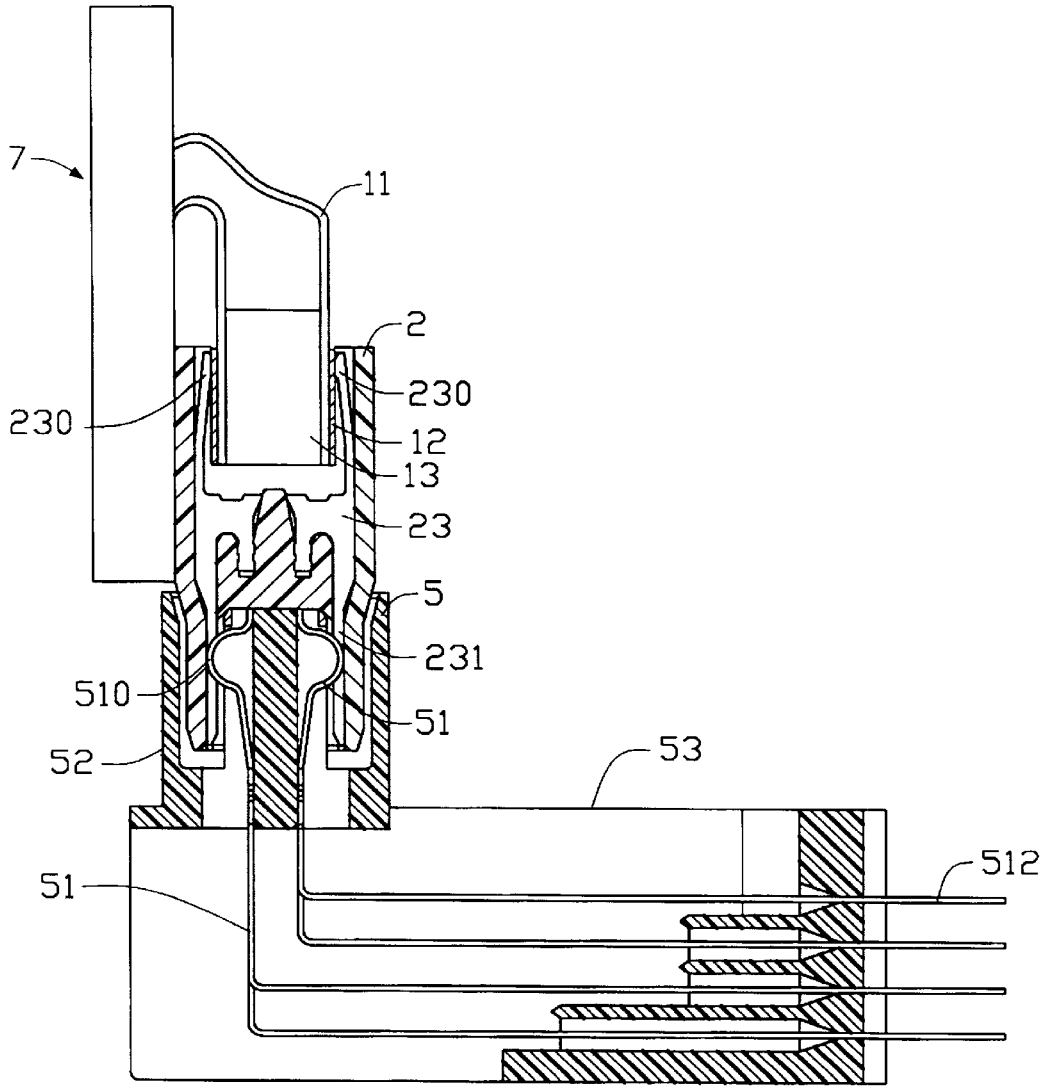
FIG. 3 is an assembled view of FIG. 2.

Referring to FIG. 3, in assembly, the connector 5 is mounted to the mother board 6. The FPC subassembly 1 is inserted into the first mating opening 21 of the medium connector 2. The contacting fingers 12 simultaneously contact the first mating ends 230 of the corresponding contacts 23. The second mating portion 24 of the medium connector 2 is then inserted into the engaging opening 50 of the connector 5 whereby the second mating ends 231 of the contacts 23 of the medium connector 2 contact the curved contact sections 510 of the corresponding terminals 51. Thus, the electrical interconnecting mechanism electrically connects the peripheral instrument 7 with the mother board 6.

Since the medium connector 2 is fixed to the peripheral instrument 7 with the help of the nuts 4 and the bolts 3, the FPC subassembly could be conveniently disengaged from the medium connector thereby safely separating the peripheral instrument 7 from the mother board 6 when the peripheral instrument 7 must be exchanged, repaired or moved. The medium connector 2 can be fixed to the peripheral instrument 7 by other mechanical means, such as by latching.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical interconnecting mechanism for interconnecting a peripheral instrument with a mother board, comprising:

a subassembly connected with an inner circuit of the peripheral instrument;

a connector mounted on the mother board, comprising a first engaging portion and a second engaging portion perpendicular to the first engaging portion for mating with the mother board; and a medium connector mechanically fixed to the peripheral instrument, comprising a first mating portion for engaging with the subassembly and a. second mating portion for engaging with the first engaging portion of the connector;

wherein a pair of nuts and a pair of bolts are provided to fix the medium connector to the peripheral instrument;

wherein a pair of apertures is defined in the medium connector for insertion of the bolts therethrough, and wherein a pair of screw holes is defined in the peripheral instrument for extension of the bolts therethrough to engage with the corresponding nuts;

wherein a first mating opening is defined in the first mating portion of the medium connector for receiving the subassembly therein;

wherein a second mating opening is defined in the second mating portion of the medium connector for receiving the first engaging portion of the connector;

wherein a plurality of contacts is fixed within the medium connector, each contact comprising a first mating end extending into the first mating opening for engaging with the subassembly, and a second mating end extending into the second mating opening for engaging with the first engaging portion of the connector mounted on the mother board;

wherein the subassembly comprises a flexible printed circuit member and a positioning member, the flexible printed circuit member being attached to opposite faces of the positioning member;

wherein a plurality of metal contacting fingers is attached on opposite outer surfaces of the flexible printed circuit member for engaging with the first mating portion of the medium connector;

wherein a plurality of terminals is fixed within the connector, each terminal comprising an engaging section for engaging with the second mating portion of the medium connector, and a connecting end for engaging with the mother board.

* * * * *